United States Patent [19]

Morell et al.

[11] Patent Number: 4,711,042

[45] Date of Patent: Dec. 8, 1987

[54] CLOSING AND TIGHTENING APPARATUS FOR A REAR-ENTRY SKI BOOT

[75] Inventors: Joseph Morell, Annecy; Jean-Louis Demarchi, Duingt, both of France

[73] Assignee: Salomon S.A., Annecy, France

[21] Appl. No.: 778,204

[22] Filed: Sep. 20, 1985

[30] Foreign Application Priority Data

Sep. 26, 1984 [FR] France ..... 84 15260

[51] Int. Cl.[4] ..... A43B 5/04; A43C 11/00

[52] U.S. Cl. ..... 36/50; 36/117; 36/105

[58] Field of Search ..... 36/117–121, 36/105, 50; 24/68 CD, 120

[56] References Cited

U.S. PATENT DOCUMENTS

| | | | |
|---|---|---|---|
| 4,408,403 | 10/1983 | Martin | 36/117 X |
| 4,571,855 | 2/1986 | Blanc | 36/117 X |
| 4,575,957 | 3/1986 | Petrini | 36/121 |
| 4,593,483 | 6/1986 | Paris . | |
| 4,596,080 | 6/1986 | Benoit et al. | 36/120 |

FOREIGN PATENT DOCUMENTS

| | | | |
|---|---|---|---|
| 0053340 | 6/1982 | European Pat. Off. | 36/117 |
| 3247516 | 6/1984 | Fed. Rep. of Germany | 36/117 |
| 3442780 | 6/1985 | Fed. Rep. of Germany | 36/117 |
| 3506057 | 2/1986 | Fed. Rep. of Germany | 36/117 |
| 2275166 | 1/1976 | France . | |
| 2448872 | 9/1980 | France | 36/117 |
| 2536254 | 5/1984 | France . | |

*Primary Examiner*—James Kee Chi

*Attorney, Agent, or Firm*—Sandler & Greenblum

[57] ABSTRACT

An apparatus for closing and tightening a boot on the foot and the lower leg of a skier. The apparatus is to be used with a boot including first and second parts. One of the parts is displaceable with respect to the other of the parts. The apparatus includes at least one linking element, a traction apparatus for applying a traction force to the at least one linking element, and an apparatus for changing the direction of the at least one linking element. One portion of the at least one linking element is attached to the first part of the boot and the other portion is attached to either the second part of the boot or the foot. The traction apparatus is positioned on the boot, and the direction changing apparatus changes the direction of the at least one linking element as the at least one linking element extends from the first part of the boot to either the second part of the boot or the foot. In addition, the direction changing apparatus is positioned on the traction apparatus.

74 Claims, 16 Drawing Figures

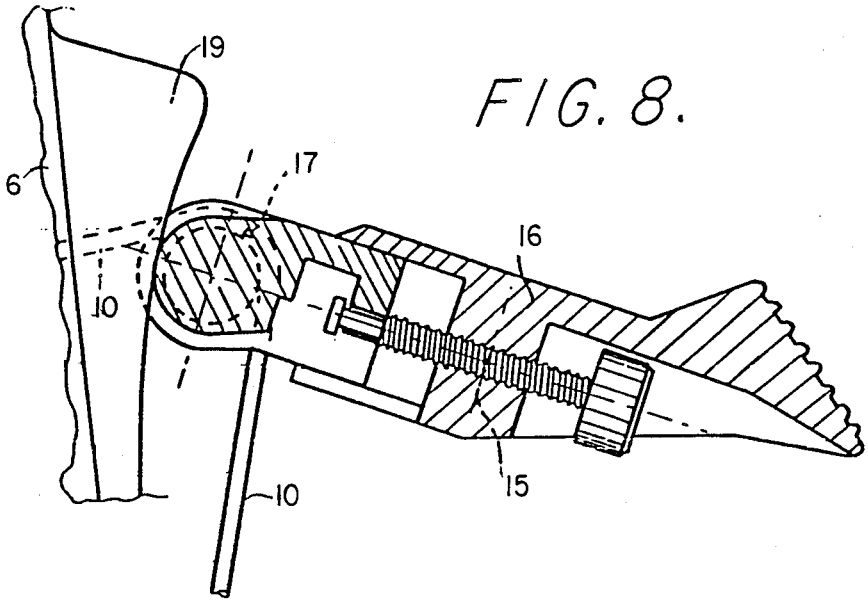
FIG. 8.
FIG. 3.
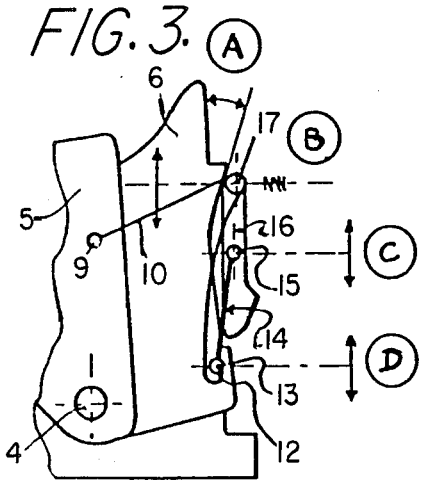

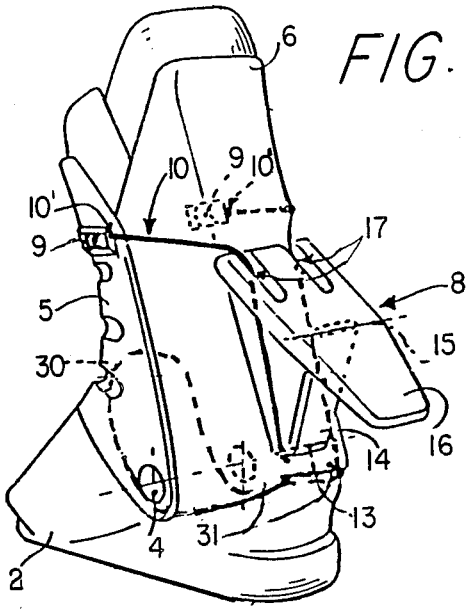
FIG. 9.
FIG. 10.
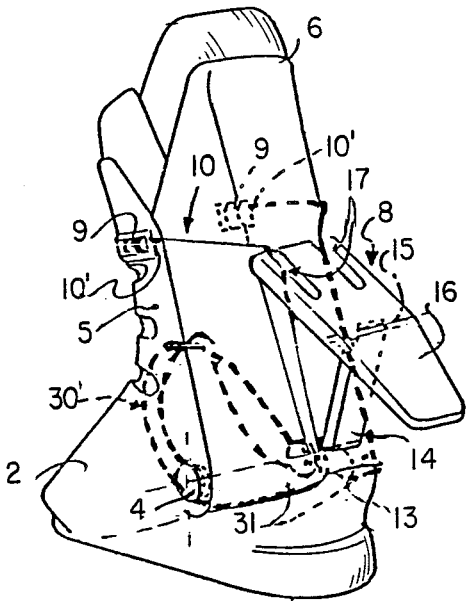
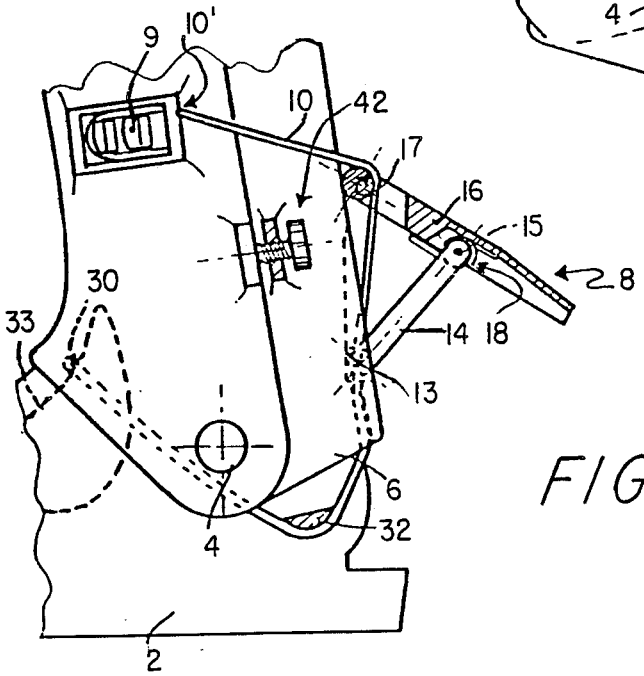
FIG. 11.

CLOSING AND TIGHTENING APPARATUS FOR A REAR-ENTRY SKI BOOT

BACKGROUND OF INVENTION

1. Field of the Invention

The invention relates to boots of the rear-entry type having an upper comprising two portions. In such boots at least one of the two portions of the upper is journalled on a rigid shell base. Such boots can be particularly adapted for alpine skiing, ice hockey, and other similar disciplines. The invention relates more particularly to a closing apparatus for automatically closing and latching the upper after the foot is introduced into the boot.

2. Description of Background Information

Various devices have been studied and applied to ski boots presently available on the market for facilitating insertion and removal of the foot from the boot, which are simple and easy to open and close particularly during skiing. The devices currently on the market are much different than those that were originally developed. Originally, boots employed laces to facilitate the insertion and removal of the foot from the boot. Laces were slowly replaced in the course of time by buckle and hook closures, of which a given number (generally four or five) were distributed along the top of the boot. With the evolution of this technology and the technology of the shoe designs, the number of closure and tightening elements was slowly reduced so that only a single element was necessary. It soon became clear that the use of a single closure element or latch was particularly well adapted for use in rear-entry boots, as is evidenced by the numerous products presently on the market, such as the type described in French Pat. No. 2,275,166, for example.

However, until recently, these single closure latches were adapted to surround the perimeter of the lower leg of the skier and the skier was required to manipulate the element with his hands. The single manipulation of a single tightening and closure apparatus, although requiring less effort than previous designs using a plurality of closure elements was not particularly desirable because women and children could not manipulate this type of latch as easily as would be desired. As a result, certain manufacturers have continued to develop means for closing and opening ski boots so as to render them easier to use.

The boots which have been improved to overcome the above-discussed problems all include a single double action lever for closing and tightening the boot. The lever is journalled on a rear spoiler of the boot and cooperates with one end of two cables. The two cables are connected at their other end to a front portion of the upper. The tightening force exerted by the double action lever causes a traction on the two cables which, in turn, causes the rear spoiler and the front portion of the upper to be brought together, and eventually results in the tightening of the boot around the lower leg when the double lever is completely folded down beyond the dead point of an elbow apparatus formed respectively by a direction changer positioned on the rear spoiler, by the journal axis around which the double action lever pivots, and by the attachment point or points of the cables on the lever.

Such a boot can be designed in many different ways, and the double lever can comprise many different designs.

According to a first embodiment that has been developed, the lever comprises a double armed lever, adapted to pivot around a journal axis which is positioned at a distance 2/10 the length of the lever from one end of the lever. In this embodiment the two cables are upper and lower cables attached respectively to each of the lever arms. When the skier wishes to close and tighten the boot, the skier exerts a downward force on the longer arm of the lever which serves to simultaneously apply a downward traction on the upper cable and an upward traction on the lower cable. This in turn causes the front moveable portion of the upper and the journalled rear spoiler to come together. Such a boot construction represents an improvement for the skier because no more than a single manipulation is required to tighten and close the boot. However, the sides of the boot require complicated cable circuits, and young children and women still have difficulty in closing the lever, which requires a large closure force.

According to a second embodiment that has been developed, the double armed lever comprises a first lever journalled directly on the rear spoiler and a second lever journalled on the median portion of the first lever. The two linking cables are then attached to this second lever at two points slightly spaced apart from one another, such that the difference in lengths of the cables positioned at different levels on the upper can be absorbed during closing of the boot. In this embodiment as well, the complexity of construction increases the manufacturing cost of the boot thereby detracting from the attractiveness of this boot, which resides in the need for only a single manipulation to close the boot.

In French Patent Application No. 83 20 413, an attempt was made to construct a ski boot having a closing and tightening system for which manual intervention is either entirely eliminated, at least partially eliminated, or which requires the force of only the user's pinkey finger to close the boot.

Such a ski boot is composed of a rigid shell base and an upper. The upper comprises at least two portions, at least one of which is journalled on the shell base. Also provided are latching and closing means for latching and closing the two upper portions together. These latching and closing means comprise at least one flexible linking element connected at one of its ends at an attachment point which may be adjustable on one of the portions of the upper, and at least one direction changing element mounted on the upper and on which the linking element is at least partially wound. The other end of the linking element is connected to a traction element provided on the other portion of the upper. The traction element is journalled on one of the portions of the upper against the force of an elastic return element which permanently exerts a return moment for closing the traction element and maintaining the linking element constantly stretched between its two ends for all open and closed positions of the two portions of the upper.

This boot overcomes the disadvantages of other previously developed boots because as a result of the traction element being biased with respect to the upper of the boot, it is possible to put on the boot and to close and tighten the boot around the lower leg of the skier with virtually no effort required on the part of the skier himself or herself.

However, although such an integrated closure apparatus allows one to automatically close and latch the boot, in order to open this boot, the skier must perform a manual manipulation, i.e. the hand or foot of the skier must pull the lever. As a result, the release of the foot from the boot can occur only as a result of a voluntary action on the part of the skier, thereby preventing premature opening which is undesirable from the point of view of safety.

In all variations on this device the traction element will assume at least two positions. In a first position, the boot is automatically closed. In a second position, the boot is open. In this open position the traction element releases the length of the linking element necessary to allow pivoting of the two portions of the upper relative to one another, so as to permit the foot to be introduced into the boot. In certain devices the traction element assumes a third position known as an intermediate or pre-closed position, beyond which the skier completes the closing movement of the traction element on the upper. In these devices the bulk of the force needed to close and latch the boot is furnished by the return moment of the elastic apparatus.

According to its general design, this boot comprises, in all embodiments, a linking element for linking together the two portions of the upper by means of a direction changing element and an adjustable attachment means for attaching the linking element to the two portions of the upper. The adjustable attachment means is positioned on one of the portions of the upper, and the direction changing element is positioned on the other portion of the upper. The direction changing element serves to retransmit along another direction the traction force exerted by the traction element on the linking element with which it cooperates. If desired, the position of the direction changing element itself can also be adjustable. The linking element, under the action of the elastic return apparatus of the traction element remains constantly subjected to a tension and is permanently taut, regardless of the relative position of the two portions of the upper with respect to one another.

This automatic closing and latching apparatus is entirely satisfactory from a technical viewpoint. However, there is a need for an apparatus which provides the same result using a simpler and more practical design, which would, as a result, be less costly.

French Pat. No. 2,536,254 proposes another device for automatically closing and latching the boot by means of the action of a single foot or ski pole on a manipulation lever. This device, which also produces satisfactory results, although the boot does not close and latch as automatically as in the previous device, is relatively complicated because it utilizes a complicated cable system. In this cable system the cables follow complicated paths around a guidance element attached to the rear spoiler of the upper which serves as a direction changer for changing the direction of the cables between their attachment points on the cuff and the manipulation lever.

In the two boots which have just been described a linking cable is attached to the cuff and extends between the attachment points of the linking cable or cables to the elements of the upper. The manipulation lever serves to stretch the cables into the closed and latched position. In addition, the cable or cables are guided by fixed elements on the rear spoiler. These fixed elements can be guidance and direction changing conduits.

Thus, in summary, there is a need for a boot which produces equivalent results to the two boots just described but which is structurally more simple and more reliable by avoiding the use of guidance and direction changing elements on the rear spoiler.

SUMMARY OF THE INVENTION

It is an object of the present invention to permit the boot to be easily closed and opened in a simple and more reliable manner than the prior art and at a lower cost.

These objects are achieved by providing an apparatus for closing and tightening a boot on the foot and leg of a skier. The apparatus of the present invention is designed to be used with a boot comprising first and second parts. One of the parts is displaceable with respect to the other of the parts. The apparatus comprises at least one linking element, traction means, and means for changing the direction of the at least one linking element. The at least one linking element comprises first and second portions. The first portion is attached to the first part of the boot at a first attachment position and the second portion is attached to one of the second part of the boot at a second attachment position and the foot of the skier. The traction means applies a traction force to the at least one linking element and is positioned on the boot. The direction changing means changes the direction of the at least one linking element as the at least one linking element extends from the first part of the boot to one of the second part of the boot and the foot. In addition, the direction changing means is positioned on the traction means intermediate the first and second attachment positions. Further, the present invention can comprise the above-described apparatus in combination with the boot described above.

The boot that is to be used with the present apparatus can further comprise a rigid shell base and an upper comprising first and second parts. The upper is at least partially journalled on the shell base. Furthermore, the first part comprises a cuff and the second part of the upper comprises a rear spoiler. The rear spoiler is journalled on the shell base and is pivotable in the longitudinal direction of the boot with respect to the cuff. The present invention also comprises the above-described apparatus in combination with such a boot.

In one embodiment, the at least one linking element can comprise one cable. Further, in still another embodiment, the first portion of the at least one linking element comprises a first and second end, and the cuff can comprise two lateral sides, so that the first and second ends of the at least one linking element are connected to different lateral sides of the cuff at different attachment points. Means can also be provided for adjusting the position of these attachment points.

In an alternative embodiment, the second portion of the at least one linking element comprises third and fourth ends of the at least one linking element. In this embodiment, the at least one linking element extends continuously between the first and third ends and between the second and fourth ends. Further, the third and fourth ends are spaced apart from each another.

In still another embodiment, the second portion of the at least one linking element comprises a flexible loop attached at a fixed point on one of the spoiler and the foot. In addition, means can be provided for attaching the loop to the rear spoiler. In this embodiment, the at least one linking element extends substantially perpendicular to and around the direction changing means, and then extends to the loop attaching means. Further, the at least one linking element can extend symmetrically on opposite sides of the loop attaching means from the loop to the first and second ends of the at least one linking element. Further, the apparatus can comprise means for adjusting the position of the fixed point at which the flexible loop is attached to one of the spoiler and the foot.

The traction means comprises first and second levers. The second lever comprises lower and upper ends and an intermediate portion between the ends. The first lever also comprises lower and upper ends. The lower end of the first lever is journalled on one of the shell base and the spoiler around a first journal. The upper end of the first lever is pivotally attached to the intermediate portion of the second lever around a second journal. The upper end of the second lever engages the rear spoiler along an area of contact therebetween. Also, the lower end of the second lever comprises a free end adapted to be pivoted by the skier around the second journal. The second lever can comprise a median portion so that the second lever is journalled on the first lever at approximately this median portion. Also, the first and second journals can extend substantially transverse to the longitudinal axis of the boot.

The first journal, the second journal, and the area of contact between the upper end of the second lever and the rear spoiler together comprise an elbow apparatus having a stable locked position in which the lower end of the second lever is positioned in a downwardmost position against the boot whereby the at least one linking element is tensioned to lock the spoiler on the cuff in response to positioning of the elbow apparatus in this stable, locked position. The elbow apparatus is also adapted to be positioned in a stable, open position in which the free end of the second lever is spaced from the boot. In this open position spoiler is unlocked thereby permitting the opening of the spoiler away from the cuff in response to positioning of the elbow apparatus in the stable, open position. Furthermore, the area of contact discussed above can comprise a line of contact between the second lever and the rear spoiler. In this embodiment, the elbow apparatus defines a neutral position or a dead point, between the locked and open positions. This neutral position is defined by the second journal being positioned substantially in a plane extending through the first journal and the line of contact between the second lever and the rear spoiler. The elbow apparatus is in this stable, open position when the second journal is positioned on one side of the plane defined above, and the elbow apparatus is in the stable, locked position when the second journal is positioned on the other side of this plane.

The rear spoiler is adapted to be displaced between open and closed positions with respect to the cuff. In such a boot, the apparatus further comprises means for permanently biasing the upper end of the second lever into contact with the rear spoiler when the spoiler is in its opened and closed positions, thereby permanently biasing the spoiler into its closed position. Furthermore, this biasing means comprises a torsion spring comprising first and second arms. The first arm contacts the first lever and the second arm contacts the second lever. Furthermore, a portion of the torsion spring extends substantially perpendicular to the second journal. In addition, the biasing means comprises means for biasing the spoiler against displacement away from the closed position, and the bias generated from the spring is sufficiently small so as to permit the skier to easily displace the spoiler away from the closed position with his foot when the foot is introduced into the boot.

The direction changing means is positioned on the second lever in the general vicinity of the upper end of the second lever and the area of contact between the rear spoiler and the second lever. Also, the direction changing means further comprises means for guiding the at least one linking element. Furthermore, the direction changing means is positioned higher than the point of attachment of the first portion of the at least one linking element to the cuff. In another embodiment, the second portion of the at least one linking element comprises a loop. In this embodiment, the apparatus further comprises means for attaching this loop to the rear spoiler in the general vicinity of the first journal. Also, the at least one linking element in this embodiment extends substantially perpendicular and over the direction changing means positioned at the upper end of the second lever, and then extends to the loop attaching means.

The at least one linking element also extends substantially rearwardly from each lateral side of the cuff to the direction changing means, and above the area of contact between the spoiler and the second lever so that the direction changing means changes the direction of the at least one linking element from substantially rearward to downward.

The traction means and the second lever are adapted to be displaced between an open and a latched position. In this embodiment, the area of contact between the second lever and the rear spoiler comprises a ramps so inclined that the ramp comprises means for increasing the contact pressure of the upper end of the second lever on the spoiler in response to displacement of the traction means. The ramp can also comprise means for increasing the contact pressure of the upper end of the second lever on the spoiler in response to displacement of the second lever and in response to displacement of the second lever from the open to the latched positions. In one embodiment, the ramp is positioned on the spoiler. Also, the apparatus in this embodiment can further comprise means for adjusting the height of the ramp and means for adjusting the slope of the ramp with respect to the spoiler. In one embodiment, the ramp is integral with the spoiler, and in an alternative embodiment, the ramp is not integral with the spoiler. In this alternative embodiment, the spoiler comprises a plurality of spaced apart openings and the apparatus further comprises an element comprising a plurality of spaced apart projections. The number of projections are less than the number of openings and the distances between adjacent projections and openings are substantially equal. In this embodiment, the ramp is journalled on this element around a transverse axis. Furthermore, the element can comprise a recessed portion and the ramp can comprise a threaded opening therein. Also provided is a screw having an end adapted to engage this recessed portion when the screw engages the threaded opening in the ramp. Rotation of the screw in the threaded opening changes the slope of the ramp.

The apparatus can further comprise means for adjusting the position of the direction changing means on the traction means. This adjusting means adjusts the position of the direction changing means in the longitudinal direction of the boot and comprises a threaded opening in the second lever and a screw in the threaded opening.

Rotation of this screw displaces the direction changing means in the longitudinal direction of the boot.

The apparatus can further comprise means for adjusting the position of the second journal. This adjusting means comprises a rack on the second lever having a plurality of slots, each adapted to engage the second journal.

The apparatus can also include means for adjusting the position of the first journal. This adjusting means also comprises a rack comprising a plurality of slots, each of which is adapted to engage the first journal. This rack is positioned on the spoiler.

The apparatus can also comprise means for attaching the second portion of the at least one linking element to the rear spoiler at an attachment point, and means for adjusting the position of this attachment point.

The second lever is adapted to be displaced into a closed position, and the at least one linking element extends in this embodiment, inside the boot over the foot so as to comprise means for holding the foot down in response to displacing the second lever into the closed position. The at least one linking element in this embodiment extends forward from the rear of the boot inside the boot to form a loop over the foot. In this embodiment, the apparatus further comprises two additional direction changing means positioned on opposite lateral sides of the spoiler for changing the direction of the at least one linking element from generally frontward to generally upward over the foot.

In an alternative embodiment, the at least one linking element also extends forward from the rear of the boot inside the boot to form a loop over the foot. In this embodiment, the apparatus further comprises two additional direction changing means positioned on opposite lateral sides of the heel portion of the shell base for changing the direction of the at least one linking element from a generally forward to generally upward as the at least one linking element extends frontwardly from the heel portion of the shell base and then upwardly to the loop over the foot.

A distribution plate can be positioned between the at least one linking element and the foot to distribute the forces for holding down the foot in the boot.

In still another alternative embodiment, the boot comprises a heel area having two openings therein. In this embodiment, the apparatus further comprises third and fourth journals for journalling the spoiler on the shell base. the at least one linking element in this embodiment comprises first and second cables, each comprising first and second ends. The first ends of the first and second cables are attached to opposite lateral sides of the cuff and the second ends of the first and second cables are attached to the third and fourth journals, respectively. The first and second cables extend rearwardly from the cuff to the direction changing means, and the cables then extend downwardly to the heel area of the boot and each cable extends through a different opening in the boot. The first cable also extends around the fourth journal and over the foot to the third journal, and the second cable extends around the third journal and over the foot to the fourth journal. In addition, the cables cross over each other above the foot.

In still another embodiment, the spoiler is adapted to be placed in a closed position on the cuff. In this embodiment, the apparatus further comprises means for adjusting the closed position of the spoiler on the cuff. This adjusting means comprises two adjusting means positioned on each lateral side of the cuff. Alternatively, these two adjusting means can be positioned on each lateral side of the spoiler. In any event, the adjusting means comprise means for adjusting the perimeter of the top of the upper to the morphology of the lower leg of the skier. Furthermore, the adjusting means can be positioned at substantially the same height as the point of attachment of the first portion to the cuff or the adjustment means can be positioned at substantially the same height as the means for journalling the spoiler on the shell base.

In still another embodiment, the traction means applies a traction force to lock the spoiler on the cuff when the traction means in closed and the invention further comprises first and second linking elements. The first linking element comprises means for locking the spoiler on the cuff in response to closing of the traction means and the second linking element comprises means for holding the foot down in the boot in response to being tensioned by the traction means. In this embodiment the direction changing means changes the direction of the first linking element. Also in this embodiment the traction means is adapted to be displaced from an opened to a closed position and is adapted to tension first and second linking elements simultaneously when displaced from its opened to its closed position.

The boot which is to used with the present invention as defined by the above embodiments comprises a rear portion and means for attaching the first linking element to the rear portion of the boot. In this embodiment, the first linking element extends directly from the cuff to the direction changing means and then to the attaching means. Also, the traction means comprises an upper end in contact with the rear spoiler and lower free end. In addition, the apparatus further comprises three additional direction changing means for changing the direction of the second linking element. Two of the additional direction changing means are positioned on opposite lateral sides of one of the spoiler and the heel of the shell base, and the third additional direction changing means is positioned on the traction means. Also, the second linking element forms a loop over the foot inside the boot and extends from both sides of the loop to the two additional direction changing means which change the direction of the second linking element from rearward to upward toward the third additional direction changing means. Further, the third additional direction changing means changes the direction of the second linking element from upward to along the longitudinal axis of the traction means in the direction toward the free lower end of the traction means.

In addition, the traction means can comprise first and second levers. The first and second levers comprise lower and upper ends and an intermediate portion between the lower and upper ends. The lower end of the first lever is journalled on the spoiler on a first journal, and the upper end of the first lever is journalled on the intermediate portion of the second lever on the second journal. In this embodiment, the upper end of the second lever contacts the rear spoiler along the line of contact therebetween. Furthermore, in this embodiment, the direction changing means is positioned on the second lever and the third additional direction changing means is positioned on the second lever between the direction changing means and the second journal. In addition, the second linking element forms a loop on the second lever the apparatus further comprises means for attaching the loop on the second lever and means for adjusting the position of the loop on the second lever.

This adjusting means comprises a bolt positioned in the second lever, and a nut threaded on the bolt. The nut comprises a U-shaped channel for receiving the loop of the second linking element on the second lever so that rotation of the bolt linearly displaces the nut and the loop. In addition, this second journal is positioned between the nut and the bolt and the third additional direction changing means. In one embodiment, the second linking element can comprise an endless loop.

In still another embodiment, the boot to be used with the present invention comprises a spoiler adapted to be closed on the cuff in a closed position. The apparatus that is to be used with such a boot comprises a third direction changing means which is higher than the two additional direction changing means on one of the spoiler and the shell base when the spoiler is in its closed position on the cuff.

In still another embodiment of the boot that is to be used with the present invention, the boot can comprise a cuff and spoiler which are both journalled around the same journal axis of the same shell base. The present invention comprises such a boot in combination with the apparatus of the present invention defined above.

In still another alternative embodiment, the boot which is to be used with the apparatus of the present invention comprises a cuff which is journalled on the shell base around a first axis to flex forwardly, and the spoiler is journalled on the cuff around a second axis different from the first axis. Again, the present invention can comprise the apparatus as defined above in combination with such a boot.

In still another embodiment, the boot that is to be used with the present invention can comprises a cuff and rear spoiler which are journalled on different journal axes forwardly around the journal axis of the cuff. Again, the present invention can comprise the apparatus defined above in combination with such a boot.

In still another embodiment, the boot adapted to be used with the apparatus of the present invention can comprise a cuff and spoiler journalled coaxially on the same journal axis on the shell base. The shell base comprises a rear heel portion, and the traction means is journalled on the rear heel portion of the shell base. Also, the traction means comprises in this embodiment first and second levers. The second lever comprises upper and lower ends and a median portion therebetween. The first lever is journalled on the rear heel portion of the shell base and the second lever is journalled on the first lever at the median portion. In this embodiment also, the upper end contacts the rear spoiler and the lower end is adapted to be pivoted by the skier. Again, the present invention can comprise the apparatus defined above in combination with such a boot.

BRIEF DESCRIPTION OF THE DRAWINGS

The technical characteristics of the invention which are claimed, and other aspects and advantages of the invention will appear more clearly from the description which follows and from the attached drawings in which:

FIG. 3 illustrates a schematic view of the cable path used in the same apparatus as FIGS. 1 and 2 by highlighting the possible adjustments of the apparatus of the present invention;

FIGS. 6, 7, and 8, respectively illustrate schematic views of additional adjustment means suggested by FIG. 3;

FIG. 9 illustrates a perspective view of an alternative embodiment of the present invention comprising a boot equipped with an apparatus in which the linking and closing cable of the upper comprises a closed buckle which also assures the internal retention of the foot in the boot;

FIG. 10 illustrates a perspective view of another embodiment in which two cable portions assure the linking and closing of the boot simultaneously with the internal retention of the foot;

FIG. 11 schematically illustrates the path of the cable on the rear of the upper of the two embodiments illustrated in FIGS. 10 and 11;

DETAILED DESCRIPTION OF PREFERRED EMBODIMENTS

Figure 1:
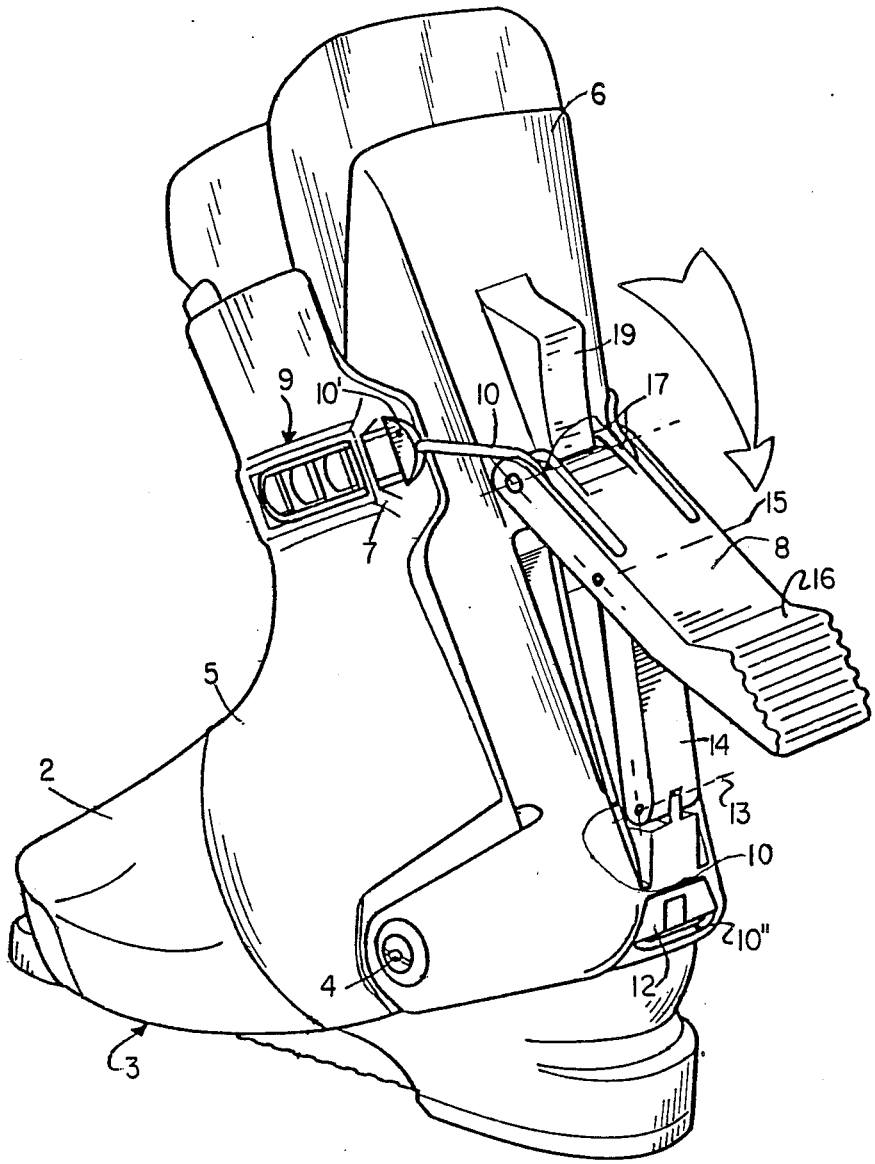
FIG. 1 is a perspective view of a boot equipped with the closure apparatus of the present invention.

The boot shown in FIGS. 1 and 2 comprises, in what is now entirely conventional in the ski boot field to which reference will be made below, a rigid shell base 2 integral with a sole 3. An upper is journalled around a transverse horizontal axis 4 on base 2. The upper comprises a front portion called a cuff 5 and a rear portion called a rear spoiler 6. According to the technical field of the invention, it is sufficient that only rear spoiler 6 be journalled on shell base 2 to allow spoiler 6 to pivot rearwardly from a closed position against cuff 5 to an open position, thereby permitting the easy introduction of the foot into the boot. Such a boot is called a rear-entry boot.

The boot further comprises a latching apparatus 7 on the upper portion of the upper which engages the lower leg. Latching apparatus 7 maintain rear spoiler 6 closed on cuff 5 around the lower leg of the wearer. Thus, apparatus 7 is a closing and latching apparatus.

Closing and latching apparatus 7 comprises an anchoring apparatus 9 on one or both lateral sides of cuff 5. Anchoring apparatus 9 can be for example, a loop and hook system for attaching a first end 10' of the linking element such as a cable 10 to a first lateral side of cuff 5. Cable 10 extends from apparatus 9 towards the rear of the upper periphery of the upper. Cable 10 can be guided rearwardly by guiding means, if desired, but preferably cable 10 is not guided by a ring (not shown because it is unnecessary) integral with cuff 5 which changes the direction of cable 10 so that cable 10 extends downwardly after extending around said ring. Cable 10 then extends downwardly toward an anchoring means 12 positioned on a double manipulation lever 8. Anchoring means 12 attaches cable 10 to spoiler 6.

Lever 8 is journalled on rear spoiler 6 or on the bottom of rear spoiler 6 or shell base 2 in a fashion known in itself. Lever 8 is adapted to be displaced between a stable, open position seen in FIG. 1, and a stable, closed and latched position seen in solid lines in FIG. 2. In its open position, lever 8 tensions able 10 so that spoiler 6 is biased into its closed position against cuff 5. However, this tension is sufficiently small so that the force of the foot and the leg on the spoiler as the leg and foot are lowered into the closed boot is sufficient to displace spoiler 6 rearward away from cuff 5 to permit entry of the foot and leg into the boot. Once the foot is placed into the boot so that the foot and leg are no longer pressing spoiler 6 rearward, spoiler 6 returns to its closed position against the cuff by the tension of cable 10. This bias of spoiler 6 into its closed position is constant, regardless of the position of lever 8 and regardless of whether spoiler 6 is in its closed position, its open position, or in any intermediate position between its open and closed positions, and is caused by an elastic element 18 which biases lever 8 against spoiler 6 for all positions of spoiler 6 and lever 8 as will be discussed in more detail below. When lever 8 is displaced into its closed position, the tension on cable 10 increases so as to lock spoiler 6 against cuff 5.

Cable 10 preferably extends substantially perpendicular to anchoring means 12. Cable 10 then forms a flexible loop 10'' near the bottom of spoiler 6. Anchoring means 12 attaches loop 10'' to spoiler 6. Cable 10 rises symmetrically on opposite sides of anchoring means 12 from loop 10''. Cable 10 then extends upwardly toward the second lateral side of cuff 5 and ends in a second end of cable 10. The second end of cable 10 is attached by an anchoring element similar to anchoring apparatus 9 which may be adjustable so as to adjust the position at which the second end of cable 10 is attached to the second lateral side of cuff 5. This anchoring element is also known in itself, and is not shown in the drawings. In addition, guidance means may be provided for first and 10' of cable 10 on cuff 5 although they are not necessary in this embodiment.

As previously explained, cable 10 preferably forms a flexible loop 10'', but it is within the scope of the invention to have a discontinuity in cable 10 substantially perpendicular to anchoring means 12. As a result, in this embodiment the two end portions of cable 10 are distinct elements which function as previously described in the other embodiments without the operation of the invention being affected.

Manipulation lever 8 is journalled around a transverse axis and journal 13 on the bottom of rear spoiler 6 adjacent to anchoring means 12. Lever 8 comprises a first half lever 14 which supports a second half lever 16 at the end of lever 14 opposite from journal axis 13. Second half lever 16 is journalled on this opposite end of first half lever 14 around journal 15. Journal 15 passes through or is adjacent to the median portion of second half lever 16. Levers 14 and 16 are adapted to be displaced between a stable, open position seen in dashed lines in FIG. 2 and a stable, closed and latched position seen in solid lines in FIG. 2. In their open position, levers 14 and 16 apply a small traction force on cable 10 so that spoiler 6 can pivot rearwardly when the foot is placed into or taken out of the boot. In their closed position, on the other hand, levers 14 and 16 tension cable 10 to lock spoiler 6 on cuff 5.

In addition, second half lever 16 is biased against pivoting around axis 15 by an elastic element 18. This elastic element 18 can comprise, for example, a torsion spring having a first arm resting against first half lever 14 and having a second arm resting against second half lever 16 in a manner so as to continuously bias the upper end of second half lever 16 against the surface of rear spoiler 6 when lever 16 and rear spoiler 6 are in their open and closed positions. The rear spoiler is thus constantly biased into the closed position but with a sufficiently small force so that it is easy for the skier to introduce his foot into the boot and to displace rear spoiler 6 against the bias of spring 18 when half lever 16 is in its open position. The spoiler thus automatically closes whenever the spoiler is opened.

Journal 13 on rear spoiler 6, journal 15 between the first and the second half levers 14 and 16, and the line of contact between the upper portion of second half lever 16 and the upper surface of the rear spoiler 6 together with or without lever 8 comprise an elbow apparatus which allows for the latching and locking and closing of the boot by displacing the free portion of second half lever 16 downwardly, (i.e., the lower portion of lever 16 opposite from the upper portion of lever 16 contacting spoiler 6) for example, with the foot, thereby displacing journal axis 15 in the direction of the arrow in FIG. 1 from one side to the other side of a plane of a neutral position (or dead point) of the elbow apparatus defined by journal axis 13 and the line of contact of second half lever 16 with rear spoiler 6.

This permanent bias for closing and/or latching of rear spoiler 6 against cuff 5 is transmitted between these two elements by cable 10. According to the invention, the cable extends rearwardly away from cuff 5 on both lateral sides thereof and then passes directly onto guide 17 on one end of lever 16. Guide 17 defines a transverse axis and which serves as a direction changer for changing the direction of cable 10 from rearward to downward substantially perpendicular to the line or zone of contact between second half lever 16 and the surface of rear spoiler 6. Cable 10 extends across this zone and then extends towards anchoring means 12 which can comprise a hook adjacent to the bottom of rear spoiler 6. There is thus no guidance and/or direction changing element for cable 10 on rear spoiler 6 before the engagement of cable 10 with manipulation lever 8, contrary to that which is known in the art discussed above. This arrangement, which preferably lacks a direction changer on cuff 5, simplifies considerably the construction of the boot by eliminating projecting portions, thereby facilitating the manufacture of the boot by injection molding. Furthermore, it enormously diminishes the friction on cable 10 and thus reduces extraneous forces tending to maintain the boot in its closed and/or latched position, the permanent bias in this direction being exerted only by the contact line between second half lever 16 and the corresponding surface of rear spoiler 6.

In addition, in the present invention the permanent closing, locking and latching functions can be accomplished by displacing second lever 16 downwardly by means of the foot or a ski pole or some other elements. When second lever 16 is displaced downwardly into its closed position, spoiler 6 is locked against cuff 5 and cannot be opened by trying to lift the foot out of the boot. The unlatching of second lever 16, (and consequently the boot) can be accomplished by foot action, or by a ski pole or other means acting upwardly on the second half lever 16 to displace second half lever 16 into its open position. Further, when second half lever 16 is unlatched into its open position, spoiler 6 is biased against cuff 5 by spring 18 with a sufficiently small force that spoiler 6 can be displaced out of its closed position by retracting the foot out of the boot. Once the foot is taken out of the boot, spoiler 6 is than automatically displaced into its closed position due to the permanent bias of spring 18.

It should also be noted that direction changer 17 of cable 10 is displaceable with lever 8. At a result, the cable path need not be long or complex. In addition, this arrangement permits cable 10 to be permanently biased downwardly by a traction force thereby increasing the useful length of cable 10 and allowing spoiler 6 to be opened to a greater extent with respect to cuff 5 than prior art boots for putting on the boot and removing the boot because cable 10 and the contact zone of the second half lever 16 with a spoiler 6 are able to descend sufficiently low in the direction of opening. As a result, there is increased comfort for the user combined with a substantial savings in the cost of manufacturing of the boot.

FIG. 3 schematically illustrates the transmission circuits of the forces in play when the apparatus is in the latched position, and FIG. 3 also illustrates the ability of the apparatus to adjust the intensity and the progression of the forces present in the course of operation of the apparatus and in the extreme latched position of the apparatus.

As seen in FIG. 3, it is within the scope of the invention to alter contact pressure between the upper end of half lever 16 and the corresponding zone of rear spoiler 6 by forming this contact zone of spoiler 6 in the shape of a ramp such as shown by reference letter A, and/or by providing means for altering the height of this contact zone, as shown by reference letter B. It is also within the scope of the invention to provide means for changing the vertical position of journal axis 15 positioned between half levers 14 and 16, as shown by reference letter C and/or to provide means for adjusting the vertical position of journal 13 around which first half lever 14 pivots on the rear spoiler as shown by reference letter D. Also, the position at which cable 10 is anchored on half lever 14 or on the rear spoiler 6 can also be adjusted by a rack apparatus such as those known in the art, and means can be provided for adjusting the position at which anchoring means 9 anchors cable 10 to cuff 5. Furthermore, as seen in FIG. 8, it is within the scope of the invention to provide means for adjusting the position of direction changer 17 with respect to second half lever 16.

Figure 2:
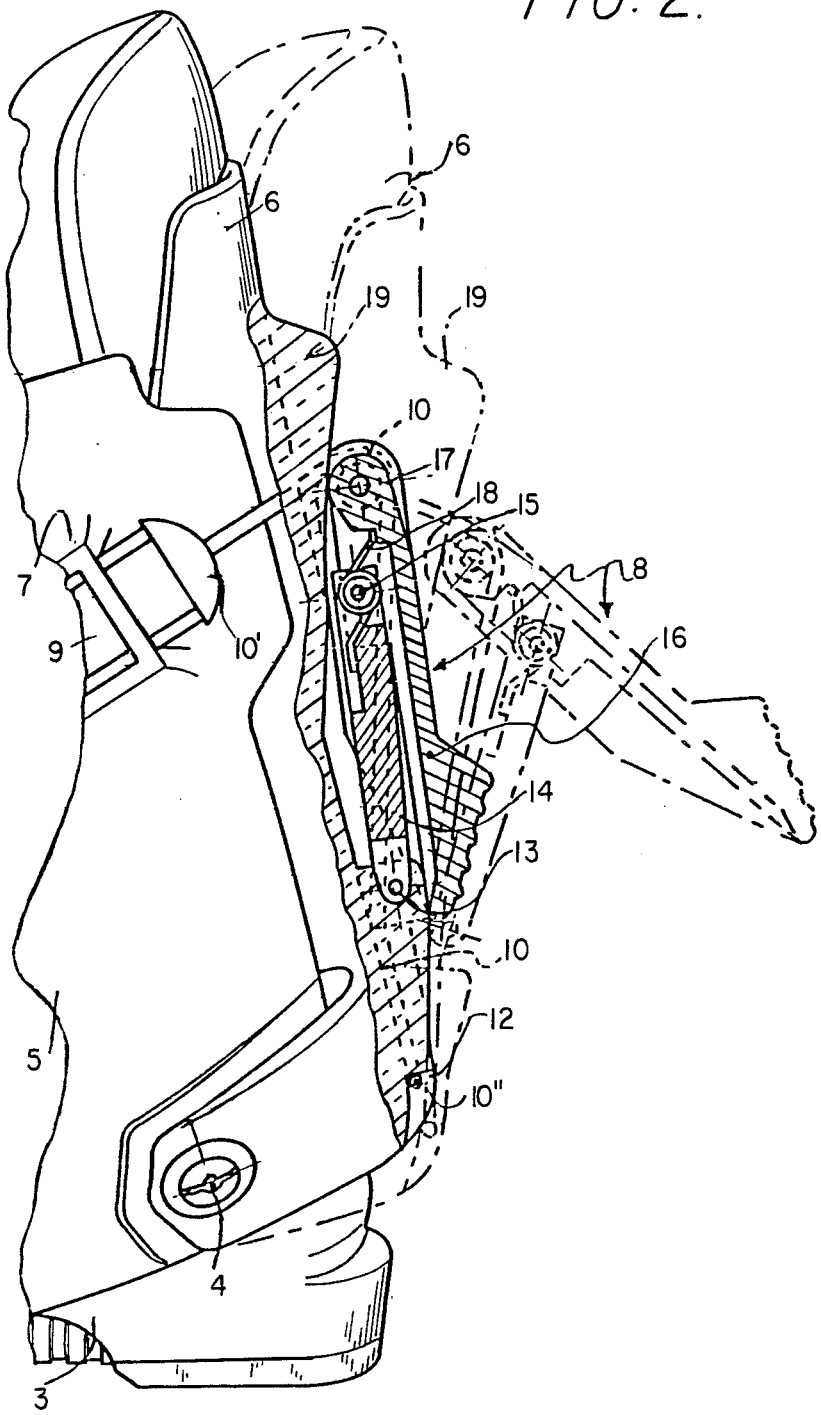
FIG. 2 illustrates a partial longitudinal crosssectional view of the apparatus of FIG. 1 in the latched, closed position in solid lines and in the unlatched or open position in dashed lines.

The first adjustment means discussed above comprises a surface in the form of ramp 19 seen in FIGS. 1 and 2. Ramp 19 extends directly above and adjacent to the line of contact between spoiler 6 and the second half lever 16. Ramp 19 also extends toward the top of spoiler 6, and ramp 19 is integral with spoiler 6 and causes a progressive increase in the contact pressure of the second half of lever 16 against spoiler 6 when lever 16 is displaced from its open position toward the closed and latched position of the boot.

Figure 4:
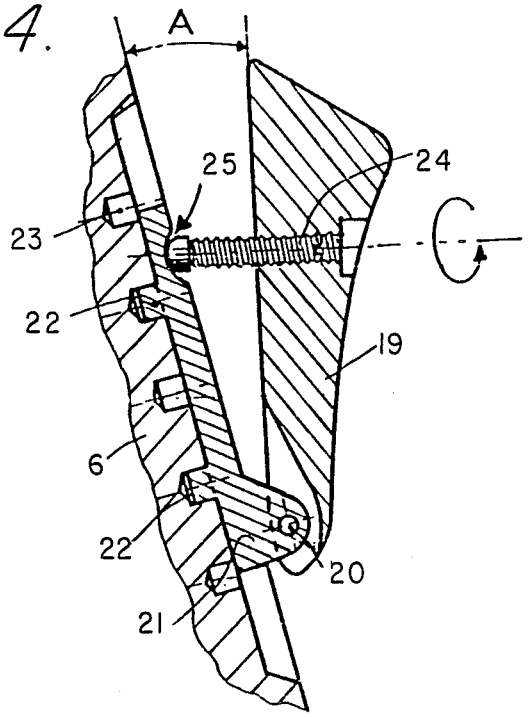
FIGS. 4 and 5 respectively illustrate schematic views of different adjustment means of the apparatus of the present invention.

FIG. 4 illustrates an embodiment in which means are provided for adjusting the slope of ramp 19 and the height of ramp 19 with respect to rear spoiler 6. In this embodiment, ramp 19 is an element distinct from rear spoiler 9. Ramp 19 is rotationally mounted around a transverse axis 20 on an intermediate element 21 on spoiler 6. Further, ramp 19 is displaceable by successive steps on spoiler 6, for example by a projection apparatus 22, the projections of which are adapted to be positioning within spaced apart holes 23 is spoiler 6. Ramp 19 can be raised or lowered by simply placing the projections in higher or lower holes 23 in spoiler 6. Once the desired positioning is achieved, the effective slope of ramp 19 can be varied by rotating screw 24 in a threaded opening in ramp 19. As a result, ramp 19 acts as a nut and is displaced in the direction of arrow A in response to the rotation of screw 24. One end of screw 24 contacts and cooperates with a curved surface 25 provided on intermediate element 21.

Figure 5:
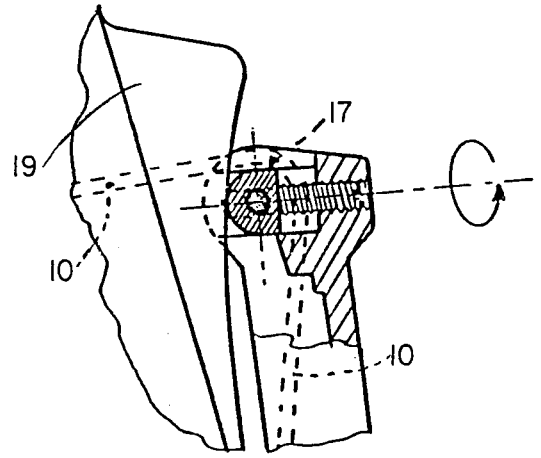

FIG. 5 illustrates means for adjusting the position of direction changer 17 which is analogous to the means for adjusting the slope of ramp 19 discussed above. In this embodiment, ramp 19 is fixed as in the embodiments illustrated in FIGS. 1 and 2, but the position of the direction changer 17 of cable 10 is adjustable in the longitudinal direction of the boot with respect to second half lever 16 by a nut and bolt apparatus similar to the means for adjusting the slope of ramp.

Figure 6:
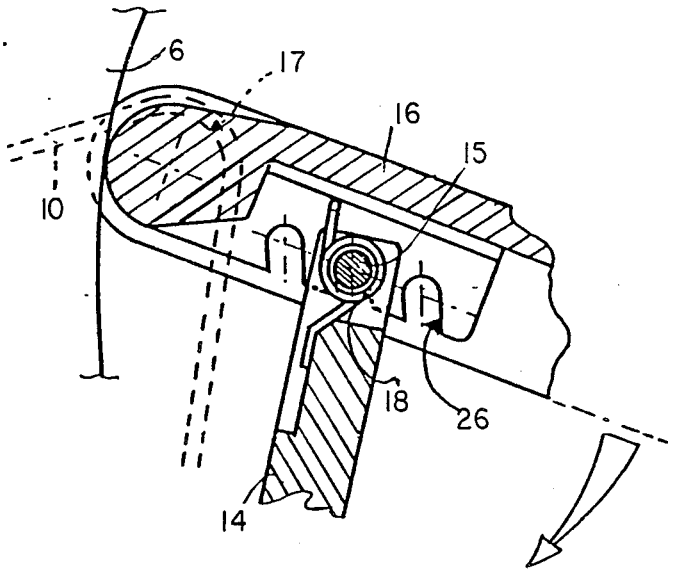

FIG. 6 illustrates means for adjusting the height of journal 15, i.e., reference letter C in FIG. 3. Second half lever 16 is journalled on first half lever 14 around journal 15, and journal 15 supports elastic element 18. The height adjustment means can displace journal 15 by successive steps in a rack 26 carried by second half lever 16, thus varying the length of the lever arms which function in the elbow apparatus.

Figure 7:
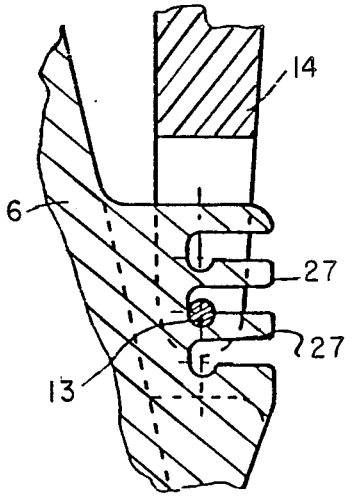

FIG. 7 illustrates means for adjusting the position of journal 13, which corresponds to adjustment D in FIG. 3. In this embodiment journal axis 13, around which first half lever 14 is journalled on the bottom of rear spoiler 6, is displaceable by successive steps in a rack apparatus 27 on spoiler 6. As previously explained, one can also provide, in addition to or as an alternative embodiment, an analogous appartus for anchoring or hooking means 12.

FIG. 8 illustrates means for adjusting the position of direction changing element 17 in the longitudinal direction with respect to second half lever 16 by means of a nut and screw apparatus. Rotation of the screw changes the position of element 17 in the longitudinal direction of lever 16.

FIG. 9 illustrates another embodiment equipped with the closing and tightening apparatus of the present invention, in which the rear spoiler is journalled on shell base 2 to allow spoiler 6 to pivot rearwardly so as to allow the foot to be inserted in the boot. As has been explained above with respect to FIG. 1, rear spoiler 6 is maintained in the closed position on the lower leg of the skier by virtue of the traction on linking and closing cable 10 at the top of the upper that is generated when manipulation lever 8, which comprises half levers 14 and 16, is placed into its stable latched position. According to this alternative embodiment, linking cable 10 extends beyond a journal zone (which surrounds and includes journal 13) at which lever 14 is journalled on the spoiler. Cable 10 extends beyond this zone and passes through an opening in the rear of the boot to form an anchoring loop 30 within shell base 2 in a zone located on top of the foot. Loop 30 is maintained at one end of the boot during conditions of use. In order to facilitate the extension of cable 10 towards the internal loop 30, angle or direction changers 31 and/or 32 are provided. Two angle changers 31 are positioned on each lateral side of the lower portion of rear spoiler 6 as seen in FIGS. 9 and 10 and two angle changers 32 are positioned on each lateral side of the rear portion of the shell base surrounding the zone of the heel as seen in FIG. 11. Loop 30 functions as an internal buckle for holding the foot down in the boot in cooperation with or without a distribution plate 33 against which loop 30 can press to hold the foot down. Of course, internal buckle 30, or its equivalent, illustrated in FIG. 10 by cable portions 30', cross the bottom of the foot where they are anchored, for example at journal 4, on each of the internal lateralla walls of the shell 2. Spoiler 6 is journalled on base 2 by journal 4. Loop 30 or cable portions 30' are placed between the wall of rigid shell base 2 and the top of a slipper insert which surrounds the foot. In addition, as discussed above a distribution plate, illustrated in FIG. 11, known in the art, can be interposed between loop 30 or 30' and the foot to distribute the internal tightening forces.

FIG. 11 illustrates in a more detailed manner the path of linkage cable 10 when spoiler 6 is closed on cuff 5 of the boot. In this figure, the position of the traction element is shown in the non-latched or open position while rear spoiler 6 is already in the closed or folded down position on the lower leg of the skier. In this state, the skier advantageously possesses the capability of walking, because spoiler 6 is free to follow the movements of the leg.

The closed position of spoiler 6 on the cuff is defined by and can be adjusted by an abutment 42. Abutment 42 may be adjusted by a screw, nut, etc. Further, abutment 42 is located on each of the lateral sides of cuff 5 and/or spoiler 6 of the upper. Abutment 42 adjusts the perimeter of the top of the upper to the morphology of the perimeters of the lower leg of different skiers. In this type of construction, adjustment abutment 42 is positioned preferably in the zone or at a height corresponding to the zone of the attachment of linkage cable 10 to the upper. However, other constructions are within the scope of the invention. For example, abutment 42 can be positioned in the zone of and at the height of the journal axes 4 of the upper.

Figure 12:
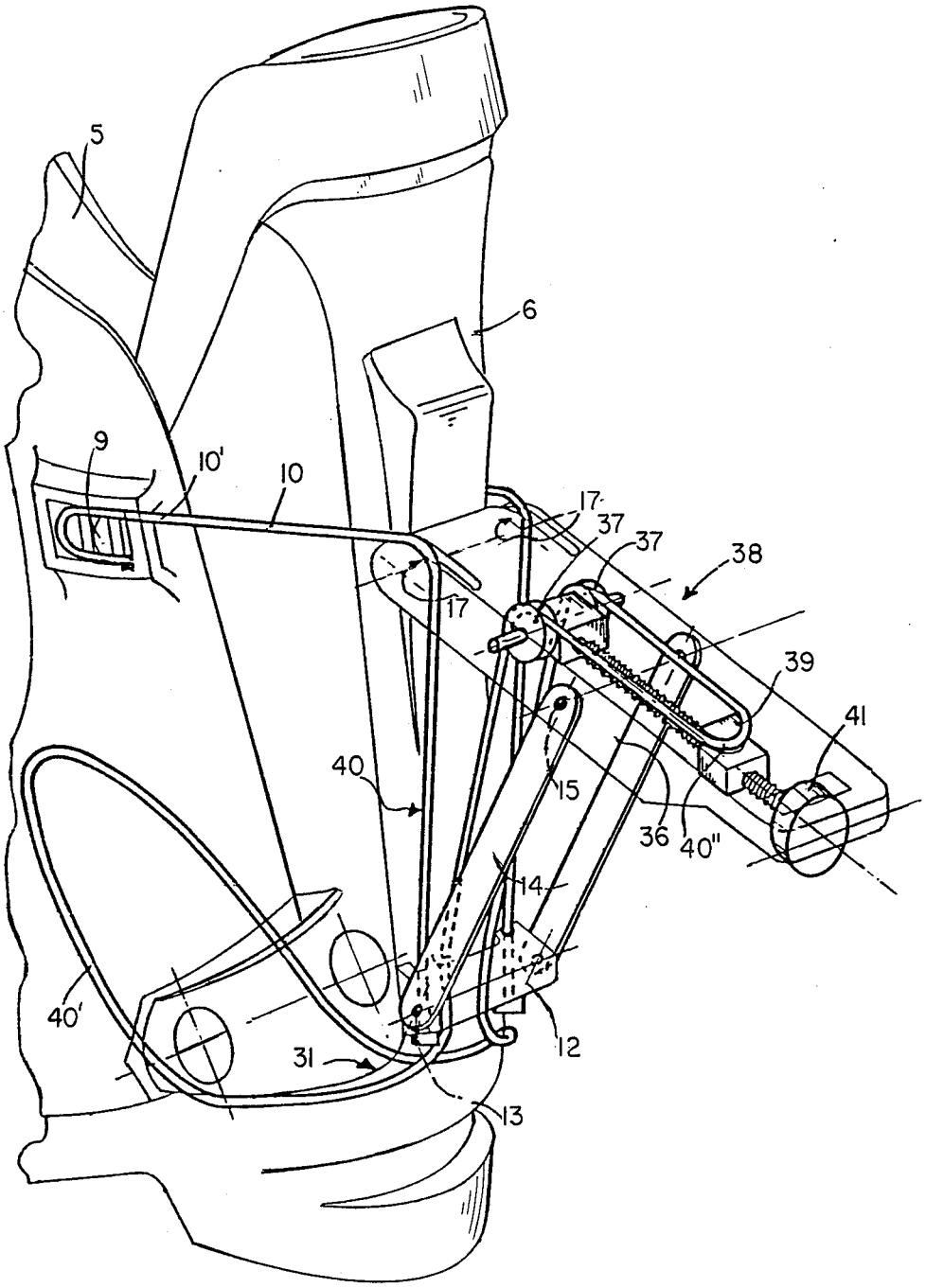
FIG. 12 illustrates a perspective view of a third embodiment according to the present invention in which the functions of closing of the upper and internally tightening the foot are separated although controlled by a single manipulation lever.

Finally, the apparatus according to the present invention is not limited to tensioning a single cable which both closes the boot and holds down the foot in the boot. According to another embodiment illustrated in FIG. 12, it is possible to hold down the foot in the boot with a cable 40 and it is possible to close the upper by means of a cable 10 which is tensioned by a traction element 38 comprising two half levers 14 and 36 such as has previously been described in the description of FIGS. 1 and 2. Lever 14 is journalled on one end at journal 13 on the bottom of the rear spoiler 6 on a bearing, serving also as attachment means 12 for the ends of loop 10" of cable 10. For reasons of construction, lever 14 can be formed by two arms as illustrated in FIG. 12. The other end of lever 14 is journalled generally or approximately at the median portion of second half lever 36 at journal 15. Second half lever 36 comprises direction changers 17 at the end of lever 36 that is in contact with spoiler 6. A portion of cables 10 extend around these direction changers 17. According to a supplemental characteristic of this embodiment, a second guidance and direction changing element 37 is provided in an extension of lever 36. Element 37 is positioned between the first direction changer element 17 and journal axis 15. This second direction changer element 37 cooperates with cable 40 holds down the foot inside the boot independently of cable 10, while being controlled by the same traction element 38. In a manner known in itself, loop 40' of cable 40 surrounds the foot in the zone of the flexion fold of the foot and extends from loop 40 towards the rear by extending around guidance elements 31 provided on the lower rear portion of spoiler 6. From element 31 cable 40 extends upwardly toward second guidance element 37 positioned on lever 36. Preferably lever 36 is provided with an attachment system 39 which is adjustable by a nut and bolt system. The nut and bolt system is longitudinally displaceable along lever 36 in response to rotation of a manipulation roller 41 which can be activated by the skier and which is positioned on the free end of traction element 38. In FIG. 12, the attachment of cable 40 for internally holding down the foot has been shown by a loop 40". It is within the scope of the present invention to form cable 40 as an endless loop.

FIGS. 13–16 illustrate several additional applications of the closing and tightening apparatus of the present invention to different types of rear-entry ski boots. It will be noted that, for simplicity sake in the drawings, the various embodiments have been schematically illustrated. However, all of the embodiments described above are applicable to each of the boots seen in FIGS. 13–16. In these additional embodiments it is obvious that liking cable 10 is not limited to being attached on the bottom of the rear of the boot. For example, it is within the scope of the invention to provide cable 10 with an extension ensuring holding down of the foot inside the boot as has been described in FIGS. 9–11. In addition, the closing apparatus can comprise a traction element 38 which by means of a single element acts on two different cables: cable 10 for the closing of the upper and cable 40 for the holding down of the foot inside the boot, as was described with reference to FIG. 12.

Figure 13:
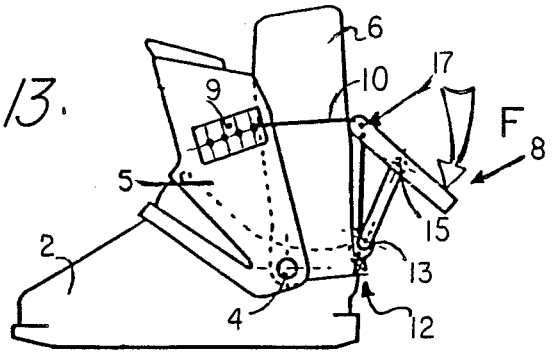
FIGS. 13–16 schematically illustrate various boot embodiments of the rear-entry type in which the apparatus according to the present invention is adapted to be used.

FIG. 13 illustrates a closing apparatus comprising a traction element 8 shown in a non-latched support position against rear spoiler 6 which is coaxially journalled on the shell base with the cuff 5. In this embodiment, the end of cable 10 is anchored, either by a buckle or by other attachment means 12 schematically illustrated on the lower rear portion of the spoiler, the arrow F indicating the latching force adapted to lock the elbow apparatus comprising the traction element.

Figure 14:
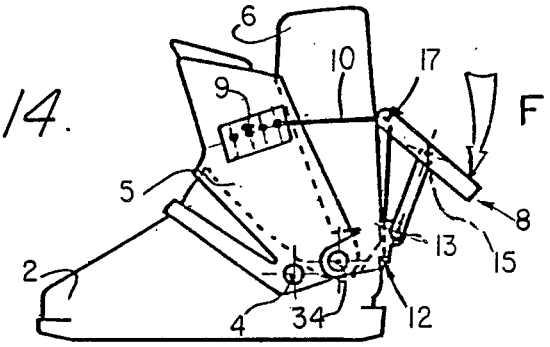

FIG. 14 illustrates the present invention applied to a boot whose rear spoiler 6 supports traction element 8. Element 8 and is journalled along an axis 34 positioned on the rear of cuff 5. Cuff 5 is itself mounted to pivot around a flexion-rotation axis 4 positioned on shell base 2 so that cuff 5 can flex forwardly around axis 4. Such a construction thus allows for a greater pivoting of spoiler 6 to the rear into the open position. In this embodiment also, the anchoring of the cable on the rear of the boot occurs at the lever of anchoring means 12 located on the lower portion of the rear spoiler.

Figure 15:
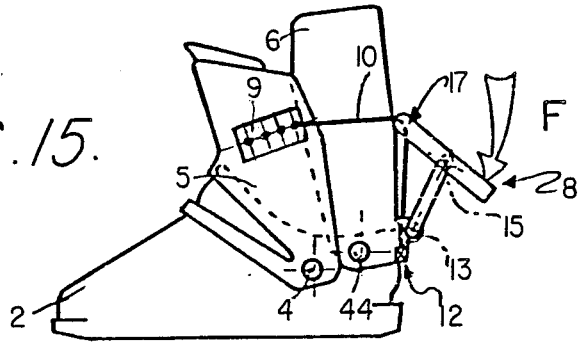
Figure 16:
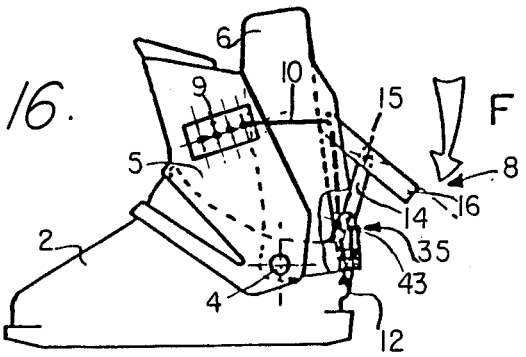

FIGS. 15 and 16 illustrate two additional embodiments of boots in which rear spoiler 6 is journalled on the shell base. However, in the embodiments of FIG. 15, rear spoiler 6 supports the traction element and is journalled on the shell base along axis 44 which is distinct from the flexion-rotation axis 4 of cuff 5.

In FIG. 16 cuff 5 and rear spoiler 6 are, as in the embodiments of FIGS. 1 or 13, coaxially connected at the bottom of the shell 2 by the flexion-rotation axis 4 of the cuff 5 which is common to cuff 5 and spoiler 6. However, traction element 8 is not journalled on the spoiler, but according to a specific construction of the spoiler in FIG. 16, traction element 8 is journalled on the rear of the shell base in the zone surrounding the heel. To this an end cap 35, indicated but not actually shown in FIG. 16, is provided. One end of half lever 14 is journalled at 43 on cap 35. In addition, cap 35 is adjacent to the upper edge of the wall of shell base 2 surrounding the heel of the skier. In this embodiment a slot 45 is provided in the rear surface of the spoiler 6 so as to allow for the passage of traction element 8.

In all of these embodiments, it is preferable to provide a support zone on the rear spoiler for supporting one end of the lever. In addition, direction changing elements 17 are located either in a plane spaced further from the plane of the heel than anchoring points 9 or direction changing elements 17 are located in a plane situated at the substantially same height as anchoring points 9. Thus, this boot simultaneously achieves a better rear support for the leg of the skier during use (the support being situated as high as possible on the rear of the upper), and can open the spoiler in the rearward direction a larger distance than has been heretofore possible by virtue of the greater length of cable that is freed for pivoting when the traction element is unlatched.

It is clear that it is within the scope of the invention to use boots in which the parameters influencing the mechanical characteristics of the elbow, as well as the constructional arrangements of the boots are equivalents or substitutes to those which have been discussed above.

Although the invention has been described with reference of particular means, materials and embodiments, it is to be understood that the invention is not limited to the particulars disclosed and extends to all equivalents within the scope of the claims.

What is claimed is:

1. An apparatus for closing and tightening a boot on the foot and leg of a skier, wherein said boot comprises a rigid shell base and an upper, wherein said upper comprises first and second parts, wherein said upper is at least partially journalled on said shell base, wherein said first part comprises a cuff and said second part comprises a rear spoiler, wherein one of said parts is journalled relative to said shell base and is pivotable in the longitudinal direction of said boot wherein one of said parts is displaceable with respect to the other of said parts, and wherein said apparatus comprises:

(a) at least one linking element comprising first and second portions, wherein said first portion is attached to said first part of said boot at a first attachment position, wherein said second portion is attached to one of said second part of said boot and said foot of said skier at a second attachment position;

(b) traction means for applying a traction force to said at least one linking element, said traction means being movably mounted relative to the part of said boot on which it is positioned; and (c) means for changing the direction of said at least one linking element as said least one linking element extends from said first part of said boot around said direction changing means along a second direction to one of said second part of said boot and said foot, wherein said direction changing means is positioned on said traction means intermediate said first and second attachment positions, to direct said linking element along said second direction.

2. The apparatus defined by claim 1 wherein said at least one linking element comprises at least one cable.

3. The apparatus defined by claim 1 wherein said first portion comprises a first and a second end of said at least one linking element, wherein said cuff comprises two lateral sides, and wherein said first and second ends are connected to different lateral sides of said cuff at different attachment points.

4. The apparatus defined by claim 3 further comprising means for adjusting the position of said attachment points.

5. The apparatus defined by claim 3 wherein said second portion comprises third and fourth ends of said at least one linking element, wherein said at least one linking element extends continuously between said first and third ends and between said second and fourth ends, and wherein said third and fourth ends are spaced from each other.

6. The apparatus defined by claim 3 wherein said second portion comprises a flexible loop attached at a fixed point on one of said spoiler and said foot.

7. The apparatus defined by claim 6 further comprising means for attaching said loop to said rear spoiler, and means for adjusting the position of said fixed point, wherein said at least one linking element extends substantially perpendicular to said direction changing means, extends around said direction changing means, and then extends to said loop attaching means.

8. The apparatus defined by claim 7 wherein said at least one linking element extends symmetrically on opposite sides of said loop attaching means from said loop to said first and second ends of said at least one linking element.

9. The apparatus defined by claim 1 wherein said traction means comprises first and second levers, wherein said second lever comprises lower and upper ends and an intermediate portion between said ends, wherein said first lever comprising lower and upper ends, wherein said lower end of said first lever is journalled on one of said shell base and said spoiler around a first journal, wherein said upper end of said first lever is pivotally attached to said intermediate portion of said second lever around a second journal, wherein said upper end of said second lever engages said rear spoiler along an area of contact therebetween, wherein said lower end of said second lever comprises a free end adapted to be pivoted by said skier around said second journal.

10. The apparatus defined by claim 11 wherein said second lever comprises a median portion, wherein said second lever is journalled on said first lever at approximately said median portion.

11. The apparatus defined by claim 10 wherein said first and second journals extend substantially transverse to the longitudinal axis of said boot.

12. The apparatus defined by claim 11 wherein said first journal, said second journal, and said area of contact between said upper end of said second layer and said rear spoiler together comprise an elbow apparatus having a stable locked position in which said lower end of said second lever is positioned in a downwardmost position again said boot, whereby said at least one linking element is tensioned to lock said spoiler on said cuff in response to positioning said elbow apparatus in said stable, locked position.

13. The apparatus defined by claim 12 wherein said elbow apparatus is also adapted to be positioned in a stable, open position in which said free end of said second lever is spaced from said boot, whereby said spoiler is unlocked, thereby permitting the opening of said spoiler away from said cuff.

14. The apparatus defined by claim 13 wherein said area of contact comprises a line of contact between said second lever and said rear spoiler, wherein said elbow apparatus defines a neutral position between said locked and open positions, wherein said neutral position is defined by said second journal being positioned substantially in a plane extending through said first journal and said line of contact between said second lever and said rear spoiler, wherein said elbow apparatus is in said stable, open position when said second journal is positioned on one side of said plane, and wherein said elbow apparatus is in said stable locked position when said second journal is positioned on the other side of said plane.

15. The apparatus defined by claim 13 wherein said rear spoiler is adapted to be displaced between open and closed positions with respect to said cuff, wherein said apparatus further comprises means for permanently biasing said upper end of said second lever into contact with said rear spoiler when said spoiler is in said open and closed positions, thereby permanently biasing said spoiler into said closed position.

16. The apparatus defined by claim 15 wherein said biasing means comprises a torsion spring comprising first and second arms, wherein said first arm contacts said first lever and said second arm contacts said second lever, wherein said torsion spring extends substantially perpendicular to said second journal.

17. The apparatus defined by claim 16 wherein said biasing means comprises means for biasing said spoiler against displacement away from said closed position, wherein the bias generated by said spring is sufficiently small so as to permit the skier to easily displace said spoiler away from said closed position with said foot to introduce said foot into said boot.

18. The apparatus defined by claim 9 wherein said direction changing means is positioned on said second lever in the general vicinity of said upper end of said second lever and said area of contact between said rear spoiler and said second lever.

19. The apparatus defined by claim 9 wherein said direction changing means further comprises means for guiding said at least one linking element.

20. The apparatus defined by claim 9 wherein said direction changing means is positioned higher than the point of attachment of said first portion to said cuff.

21. The apparatus defined by claim 9 wherein said second portion comprises a loop, said apparatus further comprising means for attaching said loop to said rear spoiler in the general vicinity of said first journal.

22. The apparatus defined by claim 21 wherein said at least one linking element extends substantially perpendicular and over said direction changing means positioned at said upper end of said second lever, wherein said at least one linking element then extends to said loop attaching means.

23. The apparatus defined by claim 9 wherein said at least one linking element extends substantially rearward from each lateral side of said cuff to said direction changing means and above said area of contact, wherein said direction changing means changes said direction of said at least one linking element from substantially rearward to downward.

24. The apparatus defined by claim 9 wherein said traction means and said second lever are adapted to be displaced between an open and a latched position, wherein said area of contact comprises a ramp so inclined that said ramp comprises means for increasing the contact pressure of said upper end of said second lever on said spoiler in response to displacement of said traction means.

25. The apparatus defined by claim 24 wherein said ramp comprises means for increasing the contact pressure of said upper end of said second lever on said spoiler in response to displacement of said second lever.

26. The apparatus defined by claim 25 wherein said ramp comprises means for increasing the contact pressure of said upper end of said second lever on said spoiler in response to displacement of said second lever from said open to said latched positions.

27. The apparatus defined by claim 26 wherein said ramp is positioned on said spoiler.

28. The apparatus defined by claim 27 further comprising means for adjusting the height of said ramp.

29. The apparatus defined by claim 28 further comprising means for adjusting the slope of said ramp with respect to said spoiler.

30. The apparatus defined by claim 29 wherein said ramp is integral with said spoiler.

31. The apparatus defined by claim 30 wherein said spoiler comprises a plurality of spaced apart openings, wherein said apparatus further comprises an element comprising a plurality of spaced apart projections, wherein the number of projections are less than the number of openings, wherein the distance between adjacent projections and openings are substantially equal, wherein said ramp is journalled on said element around a transverse axis.

32. The apparatus defined by claim 31 wherein said element comprises a recessed portion, wherein said ramp comprises a threaded opening therein, said apparatus further comprising a screw having an end adapted to engage said recessed portion when said screw engages said threaded opening in said ramp, wherein rotation of said screw in said threaded opening changes the slope of said ramp.

33. The apparatus defined by claim 9 further comprising means for adjusting the position of said direction changing means on said traction means.

34. The apparatus defined by claim 33 wherein said adjusting means comprises means for adjusting the position of said direction changing means in the longitudinal direction of said boot, wherein said adjusting means comprises a threaded opening in said second lever and a screw in said threaded opening, wherein rotation of said screw displaces said direction changing means in the longitudinal direction of said boot.

35. The apparatus defined by claim 9 further comprising means for adjusting the position of said second journal.

36. The apparatus defined by claim 35 wherein said adjusting means comprises a rack on said second lever having a plurality of slots, each adapted to engage said second journal.

37. The apparatus defined by claim 9 further comprising means for adjusting the position of said first journal.

38. The apparatus defined by claim 37 wherein said adjusting means comprises a rack comprising a plurality of slots each of which is adapted to engage said first journal, wherein said rack is on said spoiler.

39. The apparatus defined by claim 9 further comprising means for attaching said second portion to said rear spoiler at said second attachment position at an attachment point, wherein said apparatus further comprises means for adjusting the position of said attachment point.

40. The apparatus defined by claim 9 wherein said second lever is adapted to be displaced into a closed position, wherein said at least one linking element extends inside said boot over said foot so as to comprise means for holding said foot down in response to displacing said second lever into said closed position.

41. The apparatus defined by claim 40 wherein said at least one linking element extends forward from the rear of said boot inside said boot to form a loop over said foot, said apparatus further comprising two additional direction changing means positioned on opposite lateral sides of said spoiler for changing the direction of said at least one linking element from generally frontward to generally upward over said foot.

42. The apparatus defined by claim 40 wherein said at least one linking element extends forward from the rear of said boot inside said boot to form a loop over said foot, wherein said apparatus further comprises two additional direction changing means positioned on opposite lateral sides of a heel portion of said shell base for changing the direction of said at least one linking element from generally forward to generally upward as said at least one linking element extends frontwardly from the heel portion of said shell base and then upwardly to said loop over said foot.

43. The apparatus defined by claim 40 further comprising a distribution plate positioned between said at least one linking element and said foot.

44. The apparatus defined by claim 40 wherein said boot comprises a heel area having two openings therein, said apparatus further comprising third and fourth journals for journalling said spoiler on said shell base, wherein said at least one linking element comprises first and second cables, each comprising first and second ends, wherein said first end of said first and second cables are attached to opposite lateral sides of said cuff, wherein said second ends of said first and second cables are attached to said third and fourth journals, respectively.

45. The apparatus defined by claim 44 wherein said first and second cables extend rearwardly from said cuff to said direction changing means, wherein said cables then extend downwardly to the heel area of said boot, wherein said cables then extend through different openings in said boot, wherein said first cable extends around said fourth journal, and over said foot to said third journal, and said second cable extends around said third journal and over said foot to said fourth journal, wherein said cables cross over each other above said foot.

46. The apparatus defined by claim 9 wherein said spoiler is adapted to be placed in a closed position on said cuff, said apparatus further comprising means for adjusting the closed position of said spoiler on said cuff.

47. The apparatus defined by claim 46 wherein said adjusting means comprises two adjusting means positioned on each lateral side of said cuff.

48. The apparatus defined by claim 46 wherein said adjusting means comprises two adjusting means positioned on each lateral side of said spoiler.

49. The apparatus defined by claim 46 wherein said adjusting means comprises means for adjusting the perimeter of the top of said upper to the morphology of the lower leg of said skier.

50. The apparatus defined by claim 46 wherein said adjusting means is positioned at substantially the same height as the point of attachment of said first portion to said cuff.

51. The apparatus defined by claim 46 further comprising means for journalling said spoiler on said shell base, wherein said adjusting means is positioned at substantially the same height as spoiler journalling means.

52. The apparatus defined by claim 1 wherein said traction means applies a traction force to lock said spoiler on said cuff when said traction means in closed, wherein said apparatus further comprises first and second linking elements, wherein said first linking element comprises means for locking said spoiler on said cuff in response to closing said traction means, and wherein said second linking element comprises means for holding said foot down in said boot in response to being tensioned by said traction means, wherein said direction changing means changes the direction of said first linking element.

53. The apparatus defined by claim 52 wherein said traction means is adapted to be displaced from an open to a closed position and is adapted to tension said first and second linking elements simultaneously when displaced from said open to said closed position.

54. The apparatus defined by claim 53 wherein said boot comprises a rear portion and means for attaching said first linking element to said rear portion of said boot, wherein said first linking element extends directly from said cuff to said direction changing means and then to said attaching means.

55. The apparatus defined by claim 54 wherein said traction means comprises an upper end in contact with said rear spoiler and a lower free end, said apparatus further comprising three additional direction changing means for changing the direction of said second linking element, wherein two of said additional direction changing means are positioned on opposite lateral sides of one of said spoiler and said heel portion of said shell base, wherein said third additional direction changing means is positioned on said traction means, wherein said second linking element forms a loop over said foot inside said boot and extends rearward from both sides of said loop to said two additional direction changing means which change the direction of said second linking element from rearward to upward toward said third additional direction changing means, wherein said third additional direction changing means changes the direction of said second linking element from upward to along the longitudinal axis of said traction means in the direction toward said free lower end of said traction means.

56. The apparatus defined by claim 55 wherein said traction means comprises first and second levers, wherein said first and second levers each comprise lower and upper ends, and an intermediate portion between said lower and upper ends, wherein said lower end of said first lever is journalled on said spoiler on a first journal, wherein said upper end of said first lever is journalled on said intermediate portion of said second lever on a second journal, wherein said upper end of said second lever contacts said rear spoiler along a line of contact therebetween.

57. The apparatus defined by claim 56 wherein said direction changing means is positioned on said second lever, wherein said third additional direction changing means is positioned on said second lever between said direction changing means and said second journal.

58. The apparatus defined by claim 57 wherein said second linking element forms a loop on said second lever, said apparatus further comprising means for attaching said loop on said second lever to said second lever and means for adjusting the position of said loop on said second lever.

59. The apparatus defined by claim 58 wherein said adjusting means comprises a bolt positioned in said second lever and a nut threaded on said bolt, wherein said nut comprises a U-shaped channel for receiving said loop of said second linking element on said second lever, wherein rotation of said bolt linearly displaces said nut and said loop, wherein said second journal is positioned between said nut and bolt and said third additional direction changing means.

60. The apparatus defined by claim 59 wherein said second linking element comprises an endless loop.

61. The apparatus defined by claim 58 wherein said spoiler is adapted to be closed on said cuff in a closed position, wherein in said closed position of said spoiler on said cuff said third direction changing means in higher than said two additional direction changing means on one of said spoiler and said shell base.

62. The apparatus defined by claim 1 wherein said cuff and said spoiler are both journalled around the same journal axis on said shell base.

63. The apparatus defined by claim 65 in combination with said boot.

64. The apparatus defined by claim 1 wherein said cuff is journalled on said shell base around a first axis to flex forwardly, wherein said spoiler is journalled on said cuff around a second axis different from said first axis.

65. The apparatus defined by claim 64 in combination with said boot.

66. The apparatus defined by claim 1 wherein said cuff and said spoiler are journalled on different journal axes on said shell base, wherein said cuff is adapted to flex forwardly around said journal axis of said cuff.

67. The apparatus defined by claim 66 in combination with said boot.

68. The apparatus defined by claim 1 wherein said cuff and spoiler are journalled coaxially on the same journal axis on said shell base, wherein said shell base comprises a rear heel portion, wherein said traction means is journalled on said rear heel portion of said shell base.

69. The apparatus defined by claim 68 wherein said traction means comprises first and second levers, said second lever comprising upper and lower ends and a median portion therebetween, wherein said first lever is journalled on said rear heel portion of said shell base, wherein said second lever is journalled on said first lever at said median portion, wherein said upper end contacts said rear spoiler and said lower end is adapted to be pivoted by said skier.

70. The apparatus defined by claim 1 wherein said first part of said boot is adapted to be displaced between open and closed positions, wherein said apparatus further comprises means for permanently biasing said first part of said boot into said closed position.

71. The apparatus defined by claimn 70 wherein said biasing means biases said first part of said boot with a sufficiently small force so that said foot of said skier can displace said first part of said boot into said open position from said closed position by placing said foot into said boot or by retracting said foot out of said boot.

72. The apparatus defined by claim 70 wherein said biasing means comprises means for biasing said traction means against said first part of said boot so as to permanently bias said at least on linking element to close said first part of said boot.

73. The apparatus defined by claim 1 wherein said traction means, said at least one linkage element, and said direction changing means together comprise means for displacing said rear spoiler into a closed position against said cuff in response to said traction means applying said traction force to said at least one linkage element.

74. An apparatus for closing and tightening a boot on the foot and leg of a skier, wherein said boot comprises a rigid shell base and an upper, wherein said upper comprises first and second parts, wherein said upper is at least partially journalled on said shell base, wherein said first part comprises a cuff and said second part comprises a rear spoiler, wherein one of said parts is journalled relative to said shell base and is pivotable in the longitudinal direction of said boot, wherein one of said parts is displaceable with respect to the other of said parts, and wherein said apparatus comprises:

(a) at least one linking element comprising first and second portions, wherein said first portion is attached to sad first part of said boot, wherein said second portion is attached to one of said second part of said boot and said foot of said skier;

(b) traction means for applying a traction force to said at least one linking element, wherein said traction means is movably mounted on the boot part where it is positioned; and (c) means for changing the direction of said at least one linking element as said at least one linking element extends from said first part of said boot around said direction changing means along a second direction to one of said second part of said boot and said foot, wherein said direction changing means is positioned on said traction means to direct said linking element along said second direction whereby said linking element moves translationally relative to said direction changing means as traction is applied by said traction means.

* * * * *

UNITED STATES PATENT AND TRADEMARK OFFICE

CERTIFICATE OF CORRECTION

PATENT NO. : 4,711,042

DATED : December 8, 1987

INVENTOR(S) : Joseph MORELL et al.

It is certified that error appears in the above-identified patent and that said Letters Patent is hereby corrected as shown below:

Column 2, line 41, change "pinkey" to ---pinky---.

Column 2, line 67, insert ---.--- after "skier".

Column 2, line 68, delete "himself or herself".

Column 4, line 61, change "another" to ---other---.

Column 6, line 33, change "ramps" to ---ramp---.

Column 7, line 48, change "the" to ---The---.

Column 11, line 6, change "able" to ---cable---.

Column 13, line 5, change "than" to ---then---.

Column 15, line 9, change "lateralla" to ---lateral---.

Column 16, line 46, delete "and".

Column 18, line 48, change "claim 11" to ---claim 9---.

Column 18, line 55, change "claim 11" to ---claim 9---.

Column 18, line 57, change "layer" to ---lever---.

Column 18, line 61, change "again" to ---against---.

UNITED STATES PATENT AND TRADEMARK OFFICE

CERTIFICATE OF CORRECTION

PATENT NO. : 4,711,042

DATED : December 8, 1987

INVENTOR(S) : Joseph MORRELL et al.

It is certified that error appears in the above-identified patent and that said Letters Patent is hereby corrected as shown below:

Column 23, line 19, change "in" to ---is---.
Column 24, line 37, change "sad" to ---said---, Signed and Sealed this Fourth Day of October, 1988

*Attest:*

DONALD J. QUIGG

*Attesting Officer*

*Commissioner of Patents and Trademarks*